US008376879B2

(12) United States Patent
Wada et al.

(10) Patent No.: US 8,376,879 B2
(45) Date of Patent: Feb. 19, 2013

(54) GOLF CLUB HEAD

(75) Inventors: Kozue Wada, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 301 days.

(21) Appl. No.: 12/942,691

(22) Filed: Nov. 9, 2010

(65) Prior Publication Data

US 2011/0130215 A1 Jun. 2, 2011

(30) Foreign Application Priority Data

Nov. 10, 2009 (JP) ..... 2009-257541

(51) Int. Cl.
*A63B 53/04* (2006.01)

(52) U.S. Cl. ..... 473/342; 473/345

(58) Field of Classification Search ..... 473/324–350, 473/287–292

See application file for complete search history.

(56) References Cited

U.S. PATENT DOCUMENTS

| | | | | |
|---|---|---|---|---|
| 5,755,627 | A | 5/1998 | Yamazaki et al. | |
| 6,381,828 | B1 | 5/2002 | Boyce et al. | |
| 6,491,592 | B2 | 12/2002 | Cackett et al. | |
| 6,506,129 | B2 | 1/2003 | Chen | |
| 6,663,501 | B2 | 12/2003 | Chen | |
| 6,783,466 | B2 | 8/2004 | Seki et al. | |
| 6,835,145 | B2 | 12/2004 | Tsurumaki | |
| 6,949,031 | B2 | 9/2005 | Imamoto et al. | |
| 7,096,558 | B2 | 8/2006 | Sano | |
| 7,121,958 | B2 * | 10/2006 | Cheng et al. | 473/345 |
| 7,147,576 | B2 | 12/2006 | Imamoto et al. | |
| 7,153,221 | B2 | 12/2006 | Hocknell et al. | |
| 7,156,750 | B2 | 1/2007 | Nishitani et al. | |
| 7,169,059 | B2 | 1/2007 | Rice et al. | |
| 7,220,190 | B2 * | 5/2007 | Hirano | 473/342 |
| 7,344,452 | B2 | 3/2008 | Imamoto et al. | |
| 7,347,795 | B2 | 3/2008 | Yamagishi et al. | |
| 7,497,788 | B2 | 3/2009 | Imamoto et al. | |
| 7,520,822 | B2 | 4/2009 | Yamagishi et al. | |
| 7,575,525 | B2 | 8/2009 | Matsunaga et al. | |
| 7,682,262 | B2 * | 3/2010 | Soracco et al. | 473/329 |
| 7,686,706 | B2 * | 3/2010 | Matsunaga et al. | 473/329 |
| 7,785,213 | B2 * | 8/2010 | Matsunaga et al. | 473/342 |
| 7,935,003 | B2 * | 5/2011 | Matsunaga et al. | 473/342 |
| 8,231,481 | B2 * | 7/2012 | Takechi | 473/342 |
| 2003/0054901 | A1 * | 3/2003 | Sun | 473/342 |

(Continued)

FOREIGN PATENT DOCUMENTS

| | | |
|---|---|---|
| JP | 8-266690 A | 10/1996 |
| JP | 9-154985 A | 6/1997 |

(Continued)

*Primary Examiner* — Sebastiano Passaniti
(74) *Attorney, Agent, or Firm* — Sughrue Mion, PLLC

(57) ABSTRACT

A golf club head includes a head body that forms a crown portion, a sole portion, and a side portion and has an opening portion in a portion corresponding to a face portion, and a face member that is joined to the opening portion and forms the face portion. A first notch portion formed in a heel-side portion of the peripheral edge of the opening portion, and a second notch portion formed in a toe-side portion of the peripheral edge. The face member includes a first extending portion that seals the first notch portion, and a second extending portion that seals the second notch portion. The and second extending portions are more rigid than a portion of the peripheral edge.

5 Claims, 6 Drawing Sheets

U.S. PATENT DOCUMENTS

| | | | | |
|---|---|---|---|---|
| 2006/0030424 | A1* | 2/2006 | Su | 473/342 |
| 2007/0049404 | A1 | 3/2007 | Chen | |

FOREIGN PATENT DOCUMENTS

| | | | |
|---|---|---|---|
| JP | 11-313906 | A | 11/1999 |
| JP | 2000-350798 | A | 12/2000 |
| JP | 2001-062004 | A | 3/2001 |
| JP | 2001-137396 | A | 5/2001 |
| JP | 2001-187174 | A | 7/2001 |
| JP | 2002-119625 | A | 4/2002 |
| JP | 3089327 | U | 10/2002 |
| JP | 2003-052866 | A | 2/2003 |
| JP | 2003-126311 | A | 5/2003 |
| JP | 2003-230643 | A | 8/2003 |
| JP | 2004-016654 | A | 1/2004 |
| JP | 2004-024438 | A | 1/2004 |
| JP | 2004-065660 | A | 3/2004 |
| JP | 2004-222792 | A | 8/2004 |
| JP | 2004-229820 | A | 8/2004 |
| JP | 2004-357978 | A | 12/2004 |
| JP | 2005-006698 | A | 1/2005 |
| JP | 2005-006835 | A | 1/2005 |
| JP | 2005-006836 | A | 1/2005 |
| JP | 2005-137788 | A | 6/2005 |
| JP | 2007-054565 | A | 3/2007 |
| JP | 2007-216062 | A | 8/2007 |
| JP | 2008-154624 | A | 7/2008 |

* cited by examiner

FIG. 4A

| STRIKING POINT | #1 | | #2 | | #3 | | #4 | | #5 | |
|---|---|---|---|---|---|---|---|---|---|---|
| | AMOUNT OF DEFORMATION (mm) | TOTAL DISTANCE (yd) | AMOUNT OF DEFORMATION (mm) | TOTAL DISTANCE (yd) | AMOUNT OF DEFORMATION (mm) | TOTAL DISTANCE (yd) | AMOUNT OF DEFORMATION (mm) | TOTAL DISTANCE (yd) | AMOUNT OF DEFORMATION (mm) | TOTAL DISTANCE (yd) |
| TOE SIDE | 0.83 | 217.9 | 0.84 | 220.0 | 0.85 | 221.0 | 0.86 | 222.3 | 0.83 | 218.4 |
| CENTER | 1.07 | 228.0 | 1.03 | 225.0 | 1.03 | 225.0 | 1.04 | 226.0 | 1.00 | 224.0 |
| HEEL SIDE | 0.80 | 187.3 | 0.81 | 190.8 | 0.82 | 191.4 | 0.83 | 192.1 | 0.81 | 189.0 |

GOLF CLUB HEAD

BACKGROUND OF THE INVENTION

1. Field of the Invention

The present invention relates to a hollow golf club head.

2. Description of the Related Art

Wood and utility (hybrid) type golf club heads with hollow constructions have been proposed. Japanese Patent Laid-Open Nos. 9-154985 and 2001-187174 disclose golf club heads of those types, which are reinforced with ribs. Also, Japanese Patent Laid-Open No. 2005-137788 discloses a golf club head with its total distance performance improved by setting the thicknesses of the crown and sole portions locally small. Japanese Patent Laid-Open No. 2005-6698 discloses a golf club head having a face portion with its repulsion performance improved by setting the rigidity of its middle portion in the toe-to-heel direction relatively low on the front edge in the crown portion. Japanese Patent Laid-Open No. 2008-154624 discloses a golf club head having a face plate which partially extends to the crown and sole portions to reduce a decrease in total distance upon an off-center hit.

Great importance is often attached to the total distance performances of wood and utility type golf club heads, so these heads must obtain more stable total distances. The total distance of a struck golf ball is related to the striking point on the face portion of this ball. An average golfer is likely to strike golf balls at varying striking points, and, in turn, is likely to obtain varying total distances. Nevertheless, the variation in striking point has a certain tendency.

The golf club head described in Japanese Patent Laid-Open No. 2008-154624 has a face plate which extends to the crown portion on its toe side and to the sole portion on its heel side to reduce a decrease in total distance upon an off-center hit by means of flexure of the face plate.

However, an athletic golf club head often has a face plate that flexes a small amount to comply with the regulation of the repulsion force of the face portion (SLE rule). In this arrangement, the golf club head described in Japanese Patent Laid-Open No. 2008-154624 may not be able to sufficiently reduce a decrease in total distance upon an off-center hit.

SUMMARY OF THE INVENTION

It is an object of the present invention to reduce a decrease in total distance upon an off-center hit even if a member that forms a face portion flexes a small amount.

According to an aspect of the present invention, there is provided a hollow golf club head including a face portion, a crown portion, a sole portion, and a side portion, comprising: a head body which forms the crown portion, the sole portion, and the side portion and includes an opening portion in a portion corresponding to the face portion; and a face member which is joined to the opening portion and forms the face portion, the head body including a first notch portion formed in a heel-side portion of a peripheral edge of the opening portion, which is on a side of the crown portion, and a second notch portion formed in a toe-side portion of the peripheral edge, which is on a side of the sole portion, and the face member including a first extending portion which seals the first notch portion, and a second extending portion which seals the second notch portion, wherein the first extending portion is more rigid than a portion of the peripheral edge, which is on the side of the crown portion and on a toe side with respect to the first extending portion, and the second extending portion is more rigid than a portion of the peripheral edge, which is on the side of the sole portion and on a heel side with respect to the second extending portion.

Further features of the present invention will become apparent from the following description of exemplary embodiments with reference to the attached drawings.

BRIEF DESCRIPTION OF THE DRAWINGS

FIGS. 4A to 4C are a table and graphs showing the simulation results of golf club heads #1 to #5;

DESCRIPTION OF THE EMBODIMENTS

<First Embodiment>

Figure 1A:
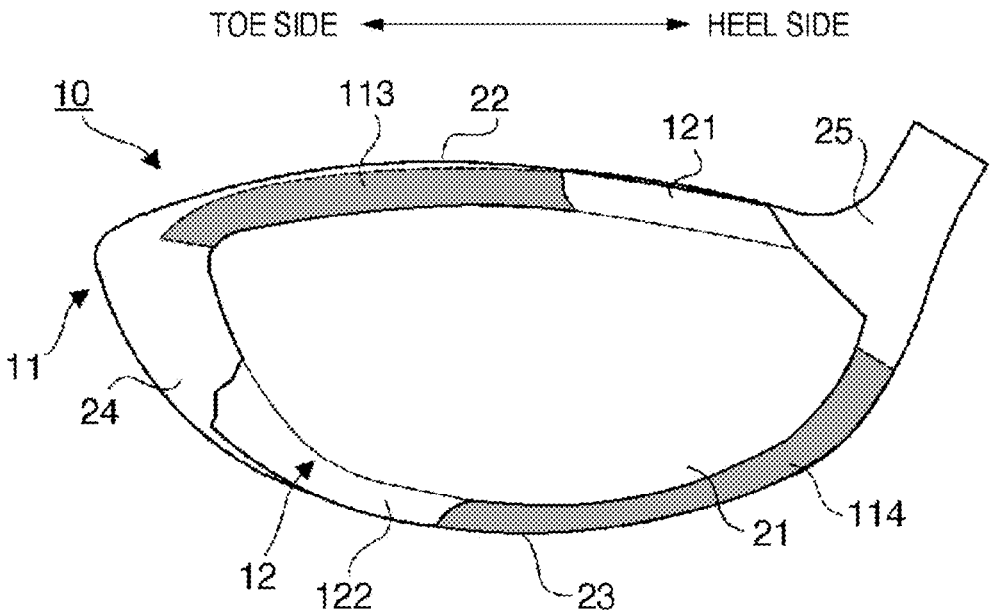
FIG. 1A is a front view of a golf club head 10.
Figure 1B:
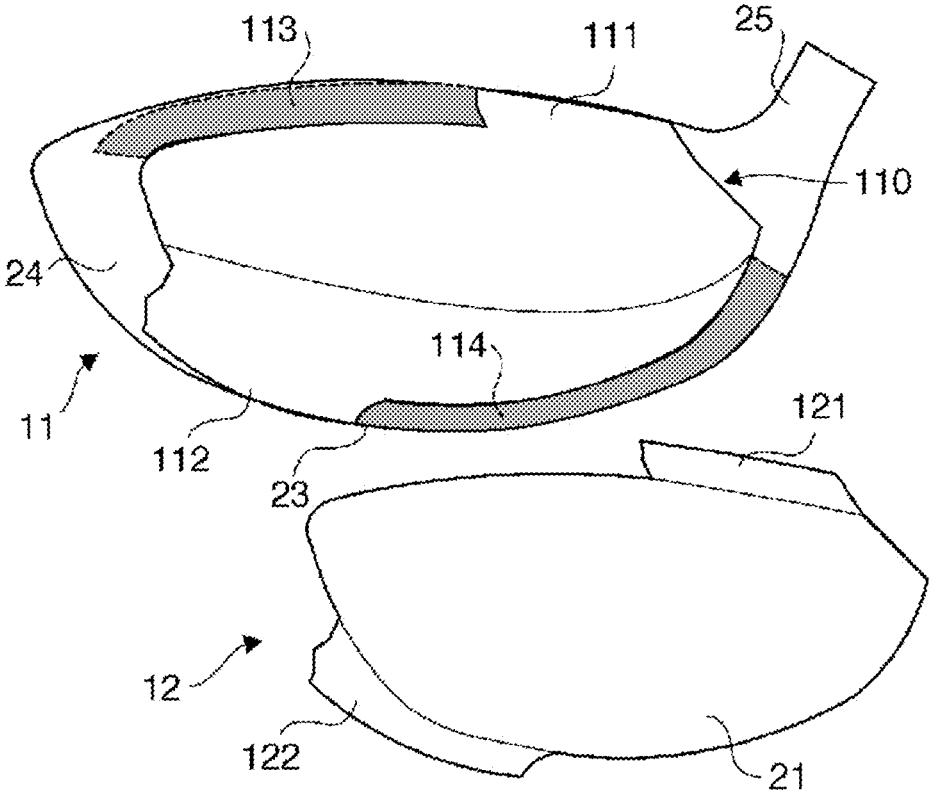
FIG. 1B is an exploded view of the golf club head 10.

FIG. 1A is a front view (a view when viewed from the side of a face portion 21) of a golf club head 10 according to an embodiment of the present invention. FIG. 1B is an exploded view of the golf club head 10. The golf club head 10 is hollow, and its peripheral wall forms the face portion 21, a crown portion 22, a sole portion 23, and a side portion 24. The face portion 21 forms the face surface (striking surface). The crown portion 22 forms the upper portion of the golf club head 10. The sole portion 23 forms the bottom portion of the golf club head 10. The side portion 24 forms the side portion of the golf club head 10. The golf club head 10 also includes a cylindrical hosel portion 25 to which a shaft is attached.

The golf club head 10 is a driver golf club head. However, the present invention is applicable not only to driver golf club heads but also to wood type golf club heads including, for example, a fairway wood type golf club head, utility (hybrid) type golf club heads, and other hollow golf club heads.

The golf club head 10 is formed by bonding a face member 12 to a head body 11. The head body 11 forms the crown portion 22, sole portion 23, and side portion 24, and has an opening portion 110 corresponding to the face portion 21. The face member 12 is joined to the opening portion 110 by, for example, welding to seal the opening portion 110, thereby forming the face portion 21. The head body 11 and face member 12 can be made of a metal material such as a titanium-based metal (for example, 6Al-4V—Ti titanium alloy), stainless steel, or a copper alloy such as beryllium copper.

The head body 11 includes a notch portion 111 formed in a heel-side portion of the peripheral edge of the opening portion 110, which is on the side of the crown portion 22, and a notch portion 112 formed in a toe-side portion of that peripheral edge, which is on the side of the sole portion 23.

The face member 12 includes an extending portion 121, which is formed to fit with the shape of the notch portion 111, and seals the notch portion 111. The extending portion 121 forms part of the crown portion 22. The face member 12 also includes an extending portion 122, which is formed to fit with the shape of the notch portion 112, and seals the notch portion 112. The extending portion 122 forms part of the sole portion 23.

The extending portion 121 is more rigid than a portion 113 (light-colored regions in FIGS. 1A and 1B) of the peripheral edge of the opening portion 110, which is on the side of the crown portion 22 and on the toe side with respect to the extending portion 121. Also, the extending portion 122 is more rigid than a portion 114 (light-colored regions in FIGS. 1A and 1B) of the peripheral edge of the opening portion 110, which is on the side of the sole portion 23 and on the heel side with respect to the extending portion 122.

To make such differences in rigidity, the following methods can be adopted. The first method sets the thickness of the extending portion 121 larger than the portion 113, and similarly sets the thickness of the extending portion 122 larger than the portion 114. In this case, the overall thickness of each of the face member 12 and head body 11 may be uniform. The second method forms the extending portion 121 using a material that is more rigid than (typically, that has a Young's modulus higher than) the material of the portion 113, and similarly forms the extending portion 122 using a material that is more rigid than (typically, that has a Young's modulus higher than) the material of the portion 114. In this case, the entire head body 11 may be made of the same material, while the entire face member 12 may be made of the same material (a material more rigid than the material of the head body 11). The third method is a combination of the above-mentioned first and second methods.

In the golf club head 10 according to this embodiment with such an arrangement, in the peripheral edge of the face portion 21 on the side of the crown portion 22, the rigidity is relatively low on the toe side because of the presence of the portion 113 and is relatively high on the heel side because of the presence of the extending portion 121. Also, in the peripheral edge of the face portion 21 on the side of the sole portion 23, the rigidity is relatively low on the heel side because of the presence of the portion 114 and is relatively high on the toe side because of the presence of the extending portion 122. As a result, the face portion 21 more easily flexes in a region on the side of the crown portion 22 and on the toe side, and in a region on the side of the sole portion 23 and on the heel side.

Figure 2A:
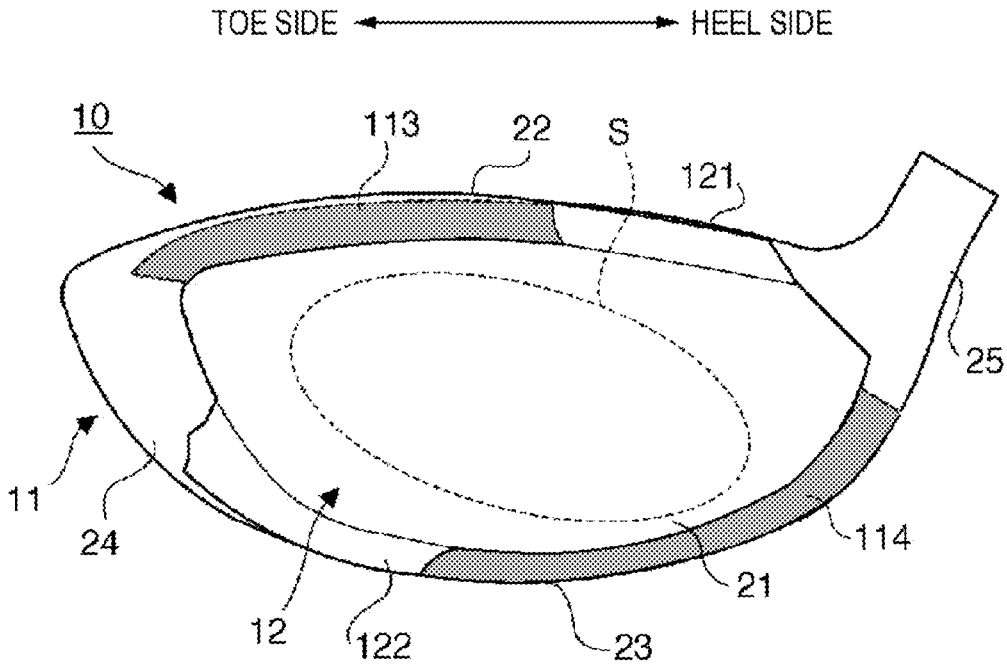
FIG. 2A is an explanatory view of a sweet area S.

Thus, the sweet area (an area in which a long total distance is expected to be attained) in the face portion 21 of the golf club head 10 is not limited to its central portion, and widens to the crown portion 22 on the toe side and to the sole portion 23 on the heel side, as indicated by a sweet area S in FIG. 2A.

The inventors of the present invention conducted a research, and concluded that an average golfer is likely to strike balls at striking points on the face portion 21, which gather together on the side of the crown portion 22 on the toe side and on the side of the sole portion 23 on the heel side. Since the golf club head 10 according to this embodiment has the sweet area S in the face portion 21, which widens to the crown portion 22 on the toe side and to the sole portion 23 on the heel side, a decrease in total distance can be reduced when an average golfer makes an off-center hit.

In addition, since the sweet area S is widened by setting the rigidities of the portions 113 and 114 relatively low, a decrease in total distance can be reduced upon an off-center hit by means of flexure of the portions 113 and 114 even if the face member 12 which forms the face portion 21 flexes little.

<Second Embodiment>

Figure 2B:
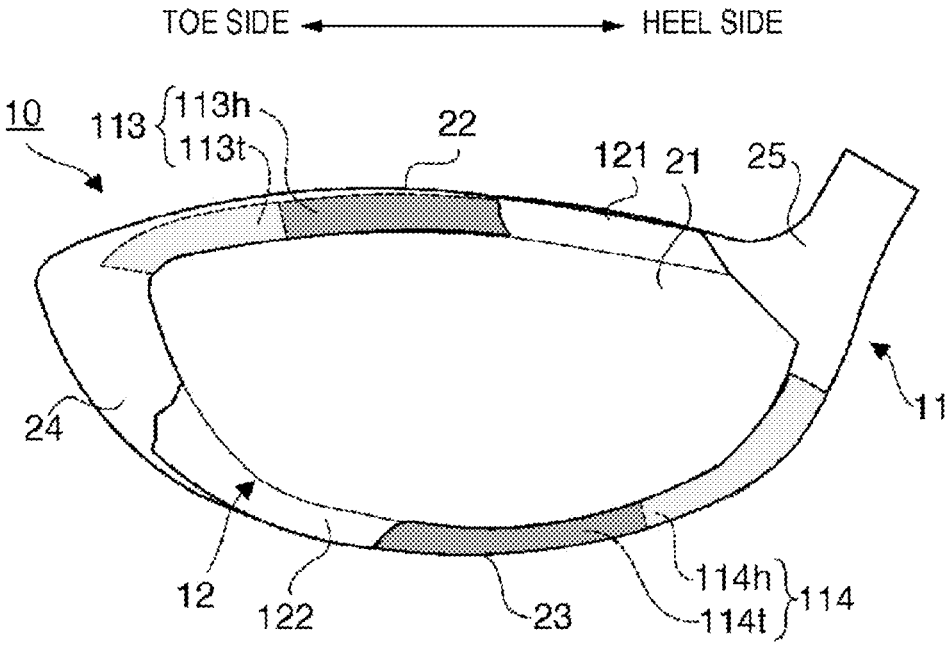
FIG. 2B is a front view showing another example of the golf club head 10.

Although the rigidities of the portions 113 and 114 are uniform in the first embodiment, they may differ between the heel and toe sides. FIG. 2B is an explanatory front view of a golf club head 10 according to this embodiment. The same reference numerals as in the golf club head 10 according to the first embodiment denote the same constituent elements in the second embodiment, and a description thereof will not be given.

A heel-side region 113*h* of a portion 113 is more rigid than its toe-side region 113*t*. A heel-side region 114*h* of a portion 114 is more rigid than its toe-side region 114*t*. To make such differences in rigidity, the above-mentioned first to third methods can be adopted.

In this manner, the rigidity of the portion 113 is set relatively low on the toe side, and that of the portion 114 is set relatively low on the heel side, thereby making it easier for a region of a face portion 21, which is on the side of a crown portion 22 and on the toe side, and that of the face portion 21, which is on the side of a sole portion 23 and on the heel side, to flex. This makes it possible to more reliably widen the sweet area.

Although both the portions 113 and 114 have rigidities which differ between the toe and heel sides, only one of them may have a rigidity which differ between the toe and heel sides.

<Third Embodiment>

Figure 3A:
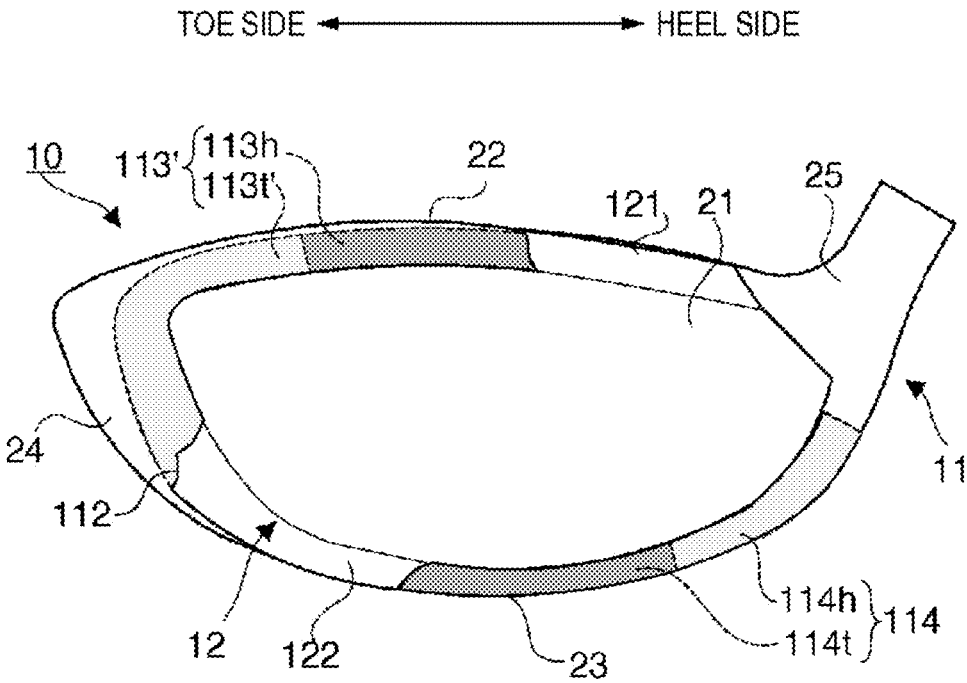
FIG. 3A is a front view showing still another example of the golf club head 10.

The portion 113 may extend to the side portion 24. FIG. 3A is an explanatory front view of a golf club head 10 according to this embodiment. The same reference numerals as in the golf club head 10 according to the first embodiment denote the same constituent elements in the third embodiment, and a description thereof will not be given.

A portion 113' which substitutes for the portion 113 extends to a side portion 24, and reaches a notch portion 112. Although the overall rigidity of the portion 113' may be uniform, a heel-side region 113*h* of the portion 113' is more rigid than a toe-side region 113*t'* of the portion 113' in this embodiment, as in the second embodiment. In this manner, the sweet area can be more reliably widened to a region of a face portion 21, which is on the side of a crown portion 22 and on the toe side, by extending the portion 113' to the side portion 24. The sweet area can be still more reliably widened to the region of the face portion 21, which is on the side of the crown portion 22 and on the toe side, by setting the rigidity of the toe-side region 113*t'* lower than the heel-side region 113*h*.

<Fourth Embodiment>

Figure 3B:
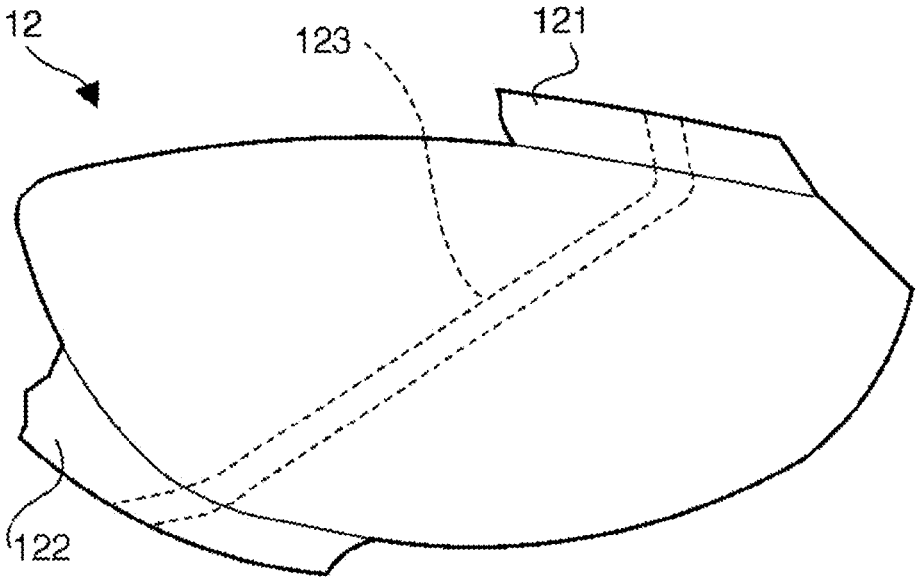
FIG. 3B is a view showing another example of a face member 12.

A rib may be provided on the face member 12 so as to cut across the face portion 21 from the extending portion 121 to the extending portion 122. FIG. 3B is an explanatory view of a face member 12 provided with a rib 123. The rib 123 is provided on the back surface of the face member 12. The rib 123 may be formed integrally with the face member 12, or may be another member fixed on the face member 12.

With this arrangement, the face member 12 can be reinforced without hindering flexing properly in a region on the side of a crown portion 22 on its toe side and in a region on the side of a sole portion 23 on its heel side.

EXAMPLE

Models of a plurality of golf club heads #1 to #5 were created on a computer, and the amounts of deformation of their face portions at the time of impact and the total distances of struck balls were simulated on the computer. FIG. 4A shows the simulation results.

All golf club heads #1 to #5 were driver hollow heads with the same shape and the same volume, and the Young's moduli of their materials were set to 125 GP. An example of a material with such a Young's modulus is a titanium alloy. Each of golf club heads #1 to #5 has a 3.0-mm thick face portion, a 0.7-mm thick crown portion, a 0.8-mm thick sole portion, and a 0.7-mm thick side portion.

Figure 5A:
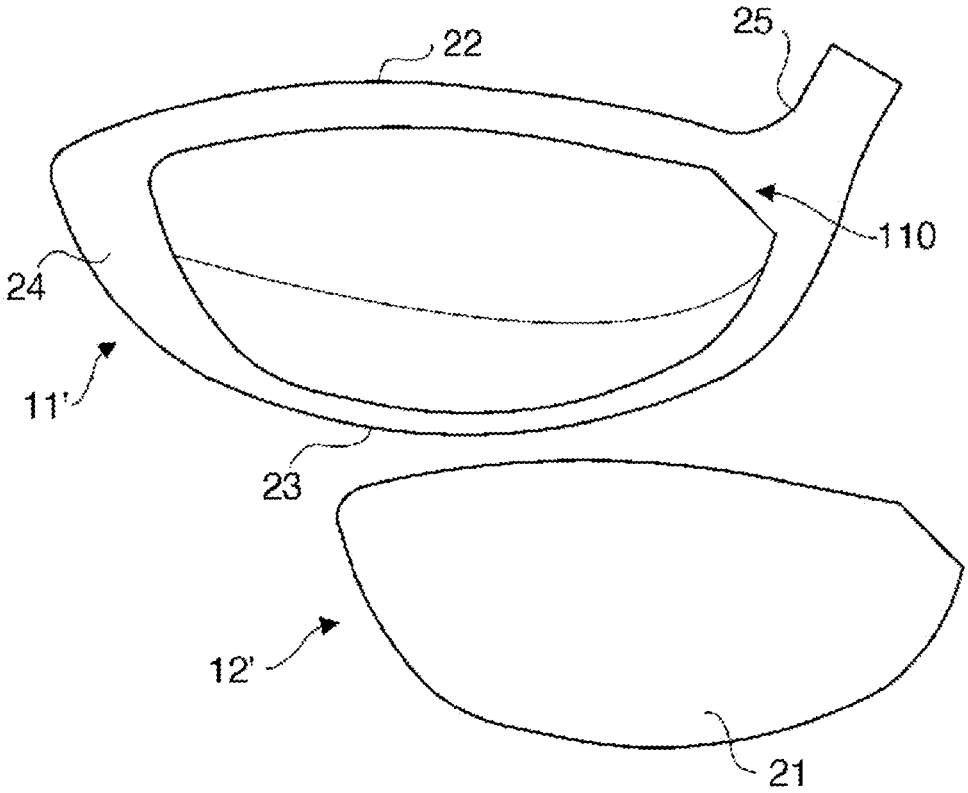
FIG. 5A is an explanatory view of golf club head #1.

Each of golf club heads #1 to #5 was formed by bonding a face member to the head body. However, only golf club head #1 employed a head body 11' and face member 12' with no portions corresponding to the above-mentioned notch portions 111 and 112 and extending portions 121 and 122, respectively, as shown in FIG. 5A. In other words, golf club head #1 exemplifies the prior art.

Each of golf club heads #2 to #5 employed a head body 11 including notch portions 111 and 112, and a face member 12 including extending portions 121 and 122, as shown in FIG. 1. The extending portions 121 and 122 have a thickness of 3.0 mm, which is equal to that of the face portion. A portion corresponding to the portion 113 has a thickness of 0.7 mm, and that corresponding to the portion 114 has a thickness of 0.8 mm. In golf club head #2, the extending portions 121 and 122 are more rigid than the portions 113 and 114, respectively, because of these differences in thickness between them.

In golf club head #3, the portions 113 and 114 were formed using materials with Young's moduli different from those of the remaining portions of the head body 11, and their rigidities were set to differ between the heel and toe sides, as shown in FIG. 2B. The Young's moduli of portions corresponding to the portions 113*h* and 114*t* were set to 100 GPa, and those of portions corresponding to the portions 113*t* and 114*h* were set to 90 GPa. Examples of materials with such Young's moduli are titanium alloys which have different compositions or are manufactured in different processes.

In golf club head #4, the portions 113 and 114 were formed using materials with Young's moduli different from those of the remaining portions of the head body 11 and, as shown in FIG. 3A, the portion 113 was extended (portion 113'), and their rigidities were set to differ between the heel and toe sides. The Young's moduli of portions corresponding to the portions 113*h* and 114*t* were set to 100 GPa, and those of portions corresponding to the portions 113*t'* and 114*h* were set to 90 GPa. Examples of materials with such Young's moduli are titanium alloys which have different compositions or are manufactured in different processes.

Golf club head #5 employed the same head body 11 as golf club head #4, and the face member 12 provided with a rib 123, as shown in FIG. 3B.

Simulations at the time of impact were performed while changing the striking point at a head speed of 45 m/s. FIG. 5B is an explanatory view of the striking points. The "Toe Side" in FIG. 4A means that the striking point is at a position indicated by a point P1 shown in FIG. 5B. Similarly, the "Center" corresponds to a point P2, and the "Heel Side" corresponds to a point P3. The point P1 is set on the crown side on the toe side. The point P2 is almost at the center of the face portion. The point P3 is set on the sole side on the heel side.

Figure 4B:
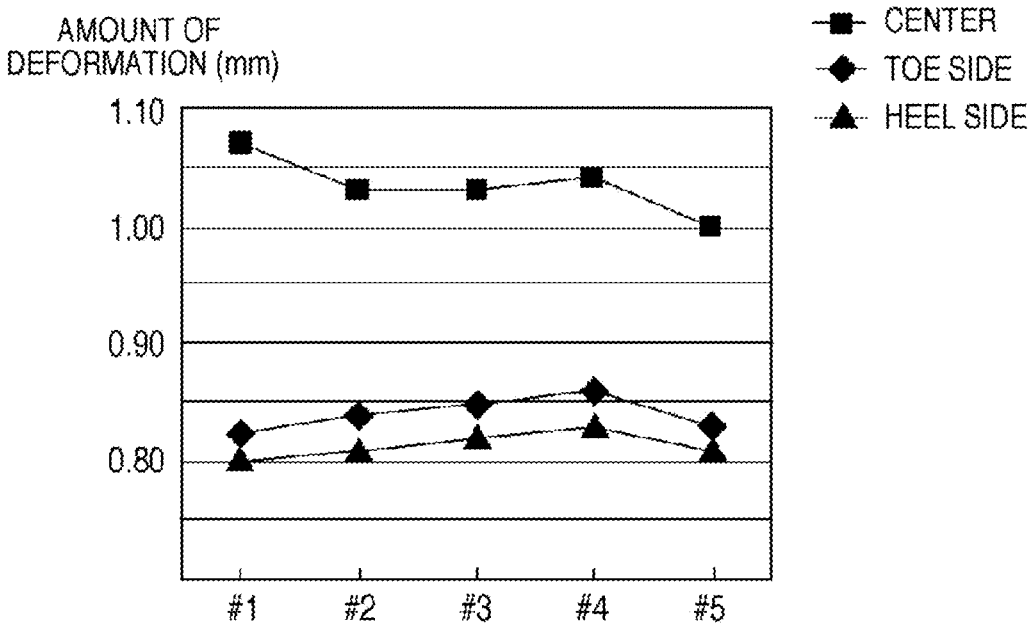
Figure 4C:
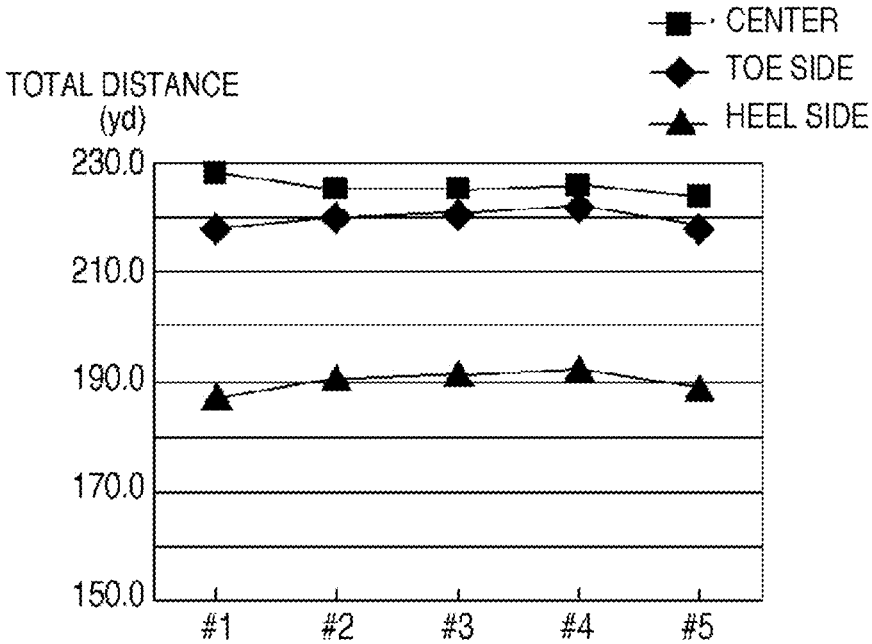
Figure 5B:
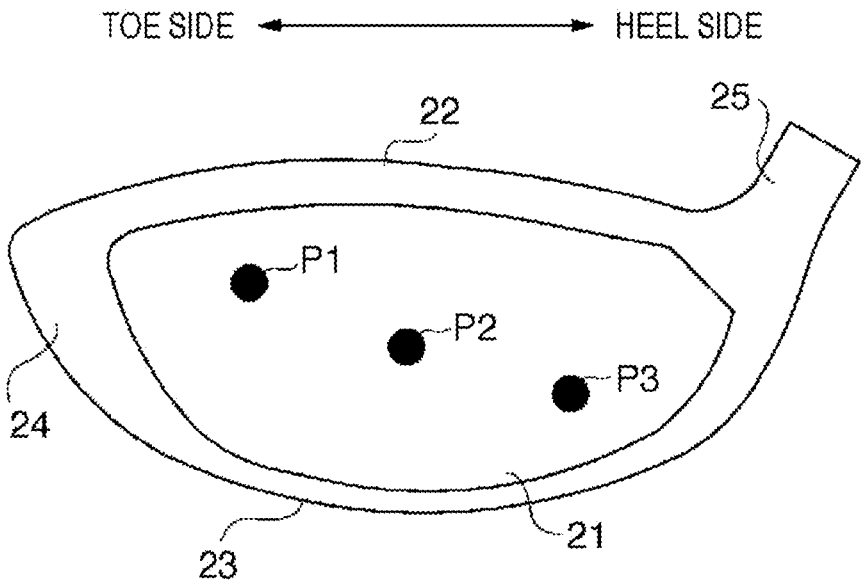
FIG. 5B is an explanatory view of the striking points.

FIGS. 4B and 4C are graphs of the simulation results. FIG. 4B shows the relationship between the amount of deformation of the face portion at the time of impact, and the striking point and golf club heads #1 to #5. FIG. 4C shows the relationship between the total distance of a struck ball, and the striking point and golf club heads #1 to #5.

As can be seen from a comparison between golf club head #1 and golf club heads #2 to #5, golf club heads #2 to #5 undergo small variations in total distance and in amount of deformation of the face portion due to a difference in striking point, so their use reduces a decrease in total distance upon an off-center hit. Hence, even a golfer who strikes balls at varying striking points, such as an average golfer, can obtain more stable total distances. It is especially obvious that more satisfactory results were obtained in golf club head #3 than in golf club head #2, and in golf club head #4 than in golf club head #3, so it is effective to set the rigidities of the portions 113 and 114 to differ between the heel and toe sides, and to extend the portion 113 to the side portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-257541, filed Nov. 10, 2009, which is hereby incorporated by reference herein in its entirety.

What is claimed is:

1. A hollow golf club head including a face portion, a crown portion, a sole portion, and a side portion, comprising:

a head body which forms the crown portion, the sole portion, and the side portion and includes an opening portion in a portion corresponding to the face portion; and a face member which is joined to the opening portion and forms the face portion, said head body including a first notch portion formed in a heel-side portion of a peripheral edge of the opening portion, which is on a side of the crown portion, and a second notch portion formed in a toe-side portion of the peripheral edge, which is on a side of the sole portion, and said face member including a first extending portion which seals said first notch portion, and a second extending portion which seals said second notch portion, wherein said first extending portion is more rigid than a portion of the peripheral edge, which is on the side of the crown portion and on a toe side with respect to said first extending portion, and said second extending portion is more rigid than a portion of the peripheral edge, which is on the side of the sole portion and on a heel side with respect to said second extending portion.

2. The head according to claim 1, wherein said first extending portion is thicker than the portion of the peripheral edge, which is on the side of the crown portion and on the toe side with respect to said first extending portion, and said second extending portion is thicker than the portion of the peripheral edge, which is on the side of the sole portion and on the heel side with respect to said second extending portion.

3. The head according to claim 1, wherein said face member is made of a material more rigid than said head body.

4. The head according to claim 1, wherein a heel-side region of the portion of the peripheral edge, which is on the side of the crown portion and on the toe side with respect to said first extending portion, is more rigid than a toe-side region thereof.

5. The head according to claim 1, wherein a heel-side region of the portion of the peripheral edge, which is on the side of the sole portion and on the heel side with respect to said second extending portion, is more rigid than a toe-side region thereof.

* * * * *